US005709640A

United States Patent [19]

Timmermans et al.

[11] Patent Number: 5,709,640

[45] Date of Patent: Jan. 20, 1998

[54] DEVICE FOR FOLDING A SHEET SUCCESSIVELY IN TWO DIRECTIONS AT RIGHT ANGLES RELATIVE TO ONE ANOTHER

[75] Inventors: Andreas P.H.M. Timmermans, Venlo; Albert Theodor Deckers, Maasbree; Martinus W.H. Van Knippenberg, Helden; Rudolf J.H.R. Deckers, Eindhoven, all of Netherlands

[73] Assignee: Oce'-Nederland, B.V., Venlo, Netherlands

[21] Appl. No.: 389,187

[22] Filed: Feb. 15, 1995

[30] Foreign Application Priority Data

Mar. 11, 1994 [NL] Netherlands ..... 9400381

[51] Int. Cl.[6] ..... B65H 45/04

[52] U.S. Cl. ..... 493/23; 493/14; 493/17; 493/417

[58] Field of Search ..... 493/3, 8, 9, 10, 493/15, 14, 17, 19, 20, 21, 73, 25, 29, 405, 413, 414, 415, 416, 434, 435, 437, 442, 443, 444, 13

[56] References Cited

U.S. PATENT DOCUMENTS

| | | | |
|---|---|---|---|
| 3,961,781 | 6/1976 | Funk | 270/20 |
| 4,944,505 | 7/1990 | Sherman | 271/265 |

FOREIGN PATENT DOCUMENTS

| | | |
|---|---|---|
| 0453909 | 10/1991 | European Pat. Off. . |
| 0472234 | 2/1992 | European Pat. Off. . |
| 0555904 | 8/1993 | European Pat. Off. . |
| 2152078 | 5/1972 | Germany . |
| 3419146 | 1/1985 | Germany . |
| 59-064450 | 4/1984 | Japan . |
| 605374 | 9/1978 | Switzerland . |
| 1394480 | 5/1975 | United Kingdom . |

*Primary Examiner*—Joseph J. Hail, III
*Assistant Examiner*—Christopher W. Day
*Attorney, Agent, or Firm*—Birch, Stewart, Kolasch & Birch, LLP

[57] ABSTRACT

A folding device includes one folding station in which a sheet can be folded zig-zag consecutively along a first dimension and in a second direction at right angles to said first dimensions. A control device automatically sets the folding device to a first folding program intended for folding an unfolded sheet, or a second folding program intended for folding a sheet already folded in one direction.

12 Claims, 6 Drawing Sheets

DEVICE FOR FOLDING A SHEET SUCCESSIVELY IN TWO DIRECTIONS AT RIGHT ANGLES RELATIVE TO ONE ANOTHER

BACKGROUND OF THE INVENTION

1. Field of the Invention

The present invention relates to a sheet folding apparatus, and more specifically, to a device for folding sheets successively along a first dimension and in a second direction at right angles to said first dimension.

2. Discussion of Related Art

German patent application 21 52 078 discloses a folding device for folding sheets in two directions. In the device described therein, a sheet can be folded in two directions by first feeding the unfolded sheet via the feed path to the folding station in order to fold the sheet in one direction, and then feed the folded sheet again via the feed path to the same folding station to fold the sheet in the other direction.

When folding large sheets of drawings, it is customary to form a folded drawing packet in a format whose length differs from the width, as in the case of the standard A4 format. To achieve this with the known device comprising one folding station, the folding station must be set to different folding distances during folding in one direction than folding in the other direction. Errors can easily occur as a result if the device operator forgets to make the correct adjustments at the right times, e.g. if, after a sheet has been folded in the first direction, he forgets to make the folding station adjustment to folding in the second direction and if, after the sheet has been folded in the second direction, he forgets to reset the folding station. A result of such lack of attention is incorrectly folded packets. Since folds once made are permanently present, it is not easily possible to make a properly folded packet from a wrongly folded packet.

SUMMARY OF THE INVENTION

Therefore, it is an object of the present invention to provide a sheet folding apparatus which will overcome the above noted disadvantages.

It is a further object of the present invention to provide a sheet folding apparatus wherein sheets may be successively folded in two directions at right angles one to the other.

The foregoing objects and others are accomplished according to the present invention, generally speaking, by providing a folding device comprising a folding station for folding a sheet in one direction and a feed path for feeding an unfolded sheet or a sheet folded in one direction to the same folding station. The feed path contains sheet-presence detection means which, as considered in a direction transverse to the feed direction, are disposed outside a part of the feed path specified for the supply of a sheet folded in one direction and control means which, in response to the reception of a detection signal from the sheet-presence detection means, adjust the folding station to a first folding program intended for folding an unfolded sheet and which, in response to the absence of a detection signal from the sheet-presence detection means, sets the folding station to a second folding program intended for folding a sheet folded in one direction in a direction at right angles thereto. As a result, drawings are obtained which are automatically folded correctly and time is saved by dispensing with adjustments which depend on the form of the sheet of drawing to be supplied, i.e., unfolded or folded in one direction.

In a further advantageous embodiment of the device according to the present invention, the above specified part of the feed path is situated on one side of the feed path and the sheet-presence detection means comprise a sheet-presence detector which, as considered in a direction transverse to the feed direction, is situated at a distance from the side greater than the maximum width to which a sheet can be folded according to the first folding program and which is smaller than the minimum width of an unfolded sheet which is supplied along the feed path and which can be folded in accordance with the first folding program. Consequently, just one sheet-presence detector is sufficient; therefore it is a simple matter for the control means to process the detection signals.

If the sheet-presence detector is at a distance from the common side of the feed path which is nearer to the minimum width than to the maximum width, then automatic adjustment to the second folding program is less sensitive to accurate feeding of a sheet folded in one direction, e.g. if such a sheet is not moved correctly along the side of the feed path, something which would otherwise readily cause a sheet folded in one direction to activate the presence detector, so that the folding station would be incorrectly set to a first folding program.

BRIEF DESCRIPTION OF THE DRAWINGS

Other features and advantages of the invention will be explained hereinafter with reference to the following detailed description of one embodiment of a device according to the present invention with reference to the accompanying drawings wherein.

DETAILED DISCUSSION OF THE INVENTION

Figure 1:
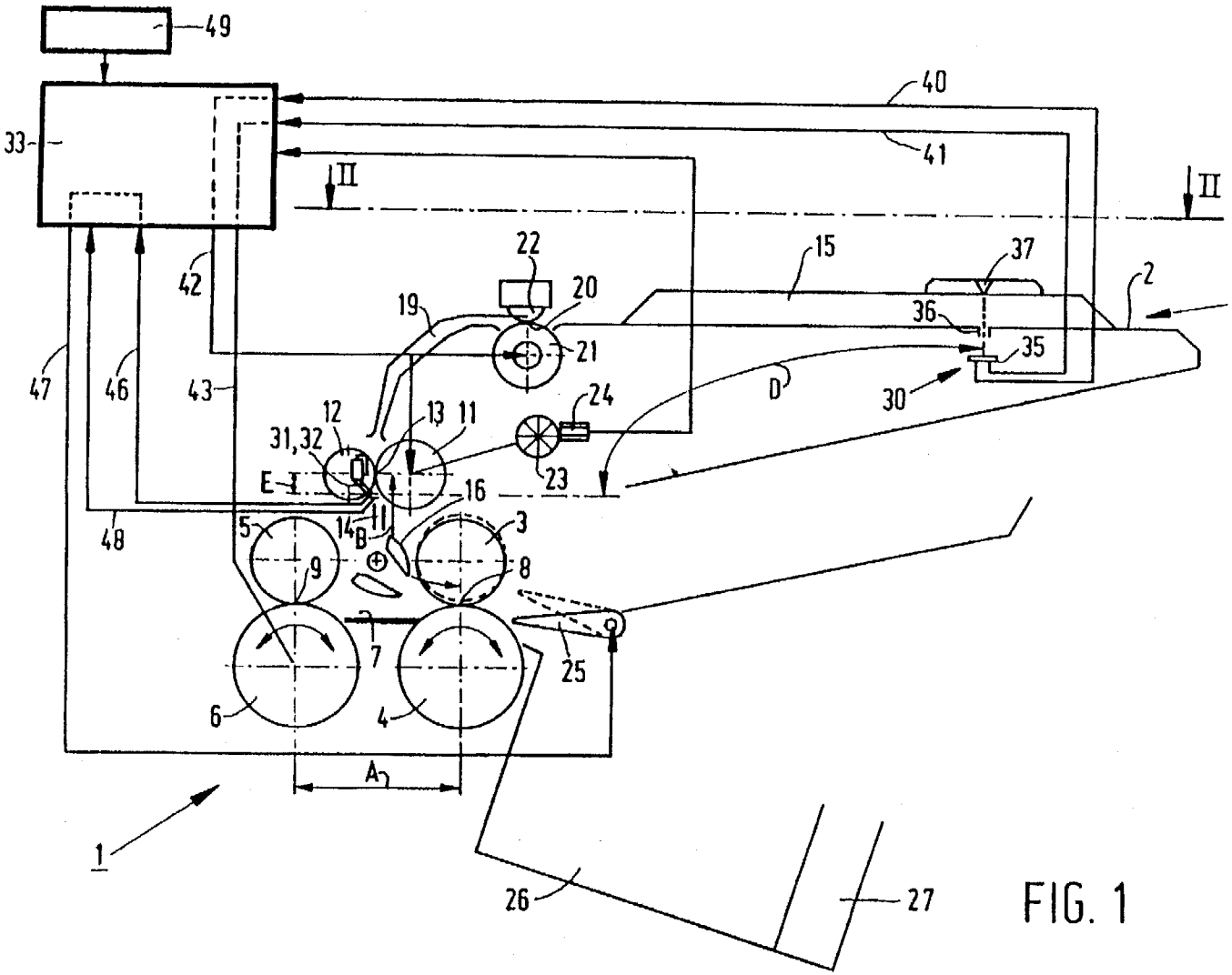
FIG. 1 is a side elevation of a device according to the invention.
Figure 2:
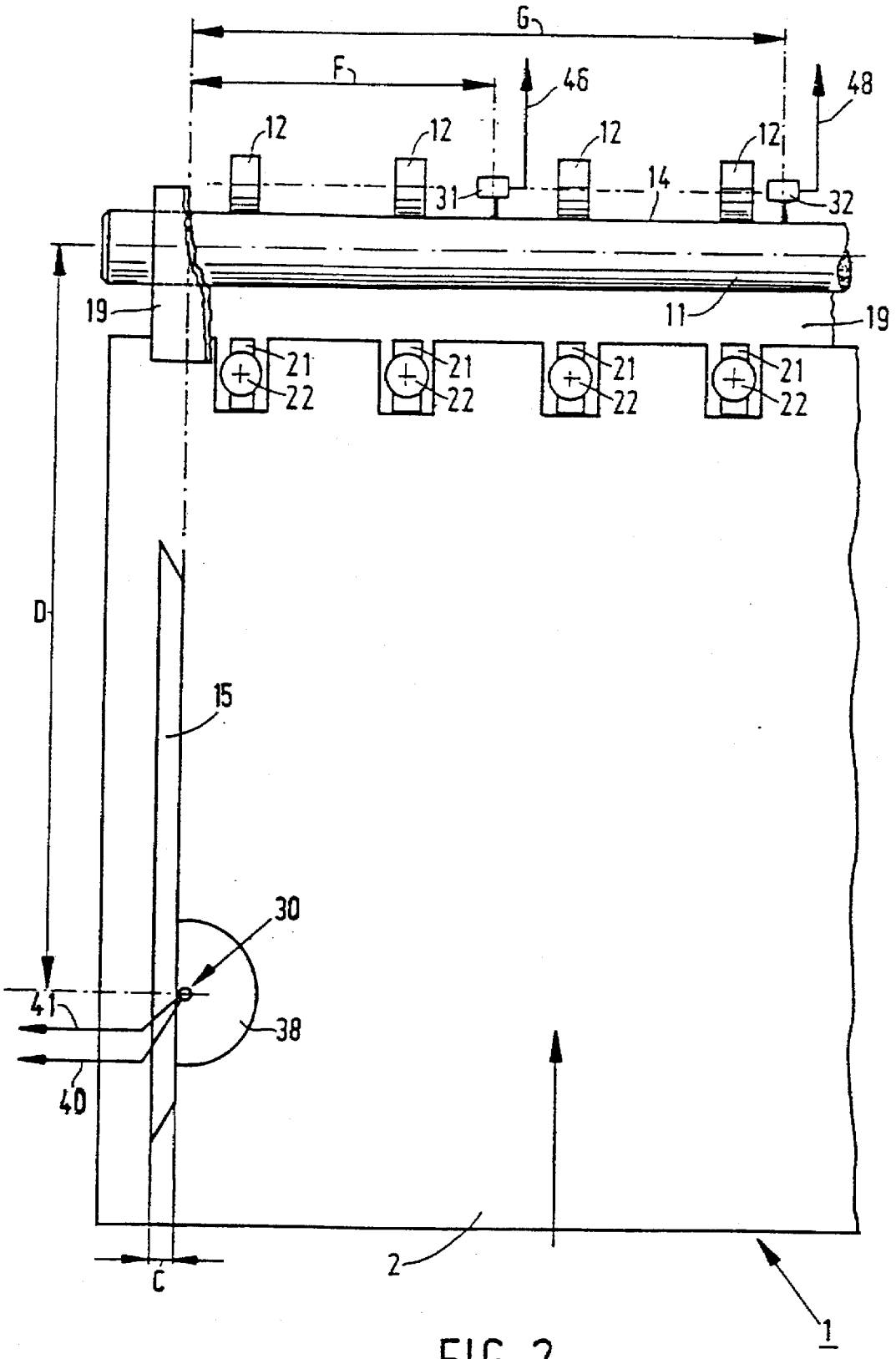
FIG. 2 is a top plan view of the device shown in FIG. 1, seen along line II—II.

The device illustrated in FIGS. 1 and 2 comprises a folding station 1 for the zig-zag folding of a sheet supplied via entry table 2. The folding station 1 is of the type illustrated in UK patent 1 394 480 and comprises a pair of folding rollers 3 and 4 and a pair of folding rollers 5 and 6, the pairs of rollers forming folding nips 8 and 9 respectively at some distance from one another in a folding plane 7.

The direction of rotation of the jointly driven folding rollers 3–6 is reversible. Transport rollers 11 and 12, the construction of which will be described hereinafter, form a transport nip 13 in a path portion 14 extending at right angles to the folding plane 7. A funnel-shaped sheet-guide member 16 is disposed in the zone between the transport nip 13 and the folding nips 8 and 9 and is movable between a position in which a sheet fed through the transport nip 13 is conveyed in the direction of folding nip 8, and a position in which the sheet fed through transport nip 13 is conveyed in the direction of folding nip 9.

To form a fold in a sheet which is fed by transport nip 13 with its leading edge between folding rollers 3 and 4 which are initially free of one another but are driven in the sheet transport direction, the direction of rotation of all of the folding rollers 3–6 is reversed and the sheet guide member 16 is moved into a position in which the sheet is fed to the folding nip 9. As a result, a loop is formed in the sheet in the space beneath the sheet guide member 16. When this loop is engaged by the folding nip 9, a fold forms in the sheet at that place. By moving the sheet guide member 16 back again and reversing the direction of rotation of the folding rollers 3–6, while the sheet is still fed through the transport nip 13, a second fold is formed in the sheet in opposition to the first fold. By repeating the reversal of the movement of the folding rollers 3–6 and the sheet guide member 16, the sheet can be folded zig-zag. The reciprocating movement of the sheet guide 16 and reversal of the direction of rotation of the folding rollers 3–6 can be controlled in the manner explained in UK Patent 1 394 480.

The feed path for supplying sheets for folding to the folding station 1 comprises a short horizontal entry table 2, on which a sheet for folding can be placed by hand against a side stop 15, which is coincident with a side margin of the feed path, and can be pushed along side stop 15 in the direction of the folding station, and a second part formed by the vertically extending path portion, in which the transport nip 13 is located. Between the two parts, i.e. the entry table 2 and the path portion, a rather sharp bend 19 is formed in the feed path.

A transport nip 20 is provided at the end of the entry table 2 which transport nip is formed by a disc roller 21 with balls 22 pressing on each disc. The light ball pressure allows a manually fed sheet to be laterally displaced in the transport nip 20 to enable the sheet to be fed straight along the side stop 15.

The transport roller 11 forming the transport nip 13 is constructed in the form of a roller extending over the width of the feed path and somewhat thicker at the ends than in the center. This concave roller 11 co-operates with a number of loose biasing rollers 12, each pressed by a leaf spring against the concave roller 11 to form a transport nip 13 extending transverse to the direction of the feed. In the half of the feed path where the side stop 15 is located, the distance between adjacent biasing rollers 12 is less than in the other half of the feed path, in order to exert a greater transport force on a fed sheet on the side-stop side. The larger diameter of the concave roller 11 at the side-stop side causes a torque to be exerted on a supplied sheet, such torque pulling and holding the sheet against the side stop 15. The transport nip 20 formed by balls 22 permits rotation of the sheet in the nip 20. Thus, if a sheet is fed obliquely in the direction of the side stop 15 it is straightened. The width of the feed path in the curve 19 permits rotation of the sheet produced by the transport nip 13, such rotation being required to pull an oblique sheet against the side stop. The curve 19 also ensures adequate stiffness of the sheet in a direction transverse to the direction of sheet feed in order to prevent the formation of creases in the feed direction. In the absence of bend 19, such creases could form by an opposite torque being exerted on part of a sheet situated on the half of the feed path remote from the side stop 15. The opposite torques exerted by the concave roller on a wide sheet which is situated on both halves of the feed path ensure that the sheet is straightened in a zone past the transport nip 13 in order to present the sheet straight to the folding station 1 and, similarly, is contracted in a zone in front of the transport nip 13. The latter is counteracted by the bend 19 just before the transport nip. Instead of a concave construction of the roller 11, which is made of Desmophan, good results have also been obtained with a straight roller 11 with a tungsten carbide surface which, by the application of pre-stressing, is bent somewhat to achieve the required straightening of the sheet.

Coupled to the driven transport roller 11 is a pulse disc 23 which, on each displacement of the peripheral surface of roller 11 over 1 mm, delivers a pulse via pulse sensor 24. The diameter of roller 11 is for this purpose regarded as a constant. In order to ensure that the leading edge of a sheet in the folding station enters the folding rollers 3 and 4 straight, the folding rollers are released from one another for the passage of the leading edge and, after the passage of the leading edge, are again pressed on one another to form a transport and folding nip 8. To free the nip 8, one end of the folding roller 3, situated on the side-stop side, is lifted by a lifting magnet intended for the purpose, while the other end of the folding roller 3 remains pressed on folding roller 4 in order to continue rotating with the driven folding roller 4 during the release of the nip 8.

To discharge a sheet from the folding station 1 after it has been folded the required number of times, a discharge deflector 25 is introduced into the folding path after the last fold so that the folded sheet is deflected downwards on its next movement in the direction of folding rollers 3, 4 and deposited in a collecting tray 26. On the side-stop side, the tray 26 is provided with a part 27 which, as considered in the direction of discharge, is longer than the rest of the tray 26 for collecting a sheet folded in two directions, such sheet being longer in the discharge direction than a sheet folded in one direction.

For the zig-zag folding of 1 m wide sheets, the transport rollers 11, 12, the folding rollers 3–6 and the sheet-guide member 16 must at least have the same length. For adequate rigidity at that length, the rollers and guide member must have dimensions such that the distance A between the folding nips 8 and 9 is approximately 90 mm minimum. The distance B between the transport nip 13 and each of the folding nips 8 and 9 must also be about 90 mm minimum, as considered along the shortest path that a sheet can follow therebetween. For the maximum compactness of construction of the folding device, the folding device shown in FIGS. 1 and 2 is so constructed that A=B=90 mm.

The description given hereinbefore is considered sufficient for an understanding of the mechanical action of a folding device according to the present invention.

The description which now follows relates to the elements required to control the folding device according to the invention. The control system of the folding device shown in FIGS. 1 and 2 comprises three detectors 30, 31, and 32 disposed at the feed path for a sheet to be folded, these detectors delivering detection signals to a control device 33 in response to the detection of the leading and trailing edges respectively of a supplied sheet, such detection signals being delivered so that operative parts of the folding device can be activated at the required times, e.g. driving transport rollers 12 and 11 in the feed path, lifting of folding roller 3 during the entry of the leading sheet edge, driving the folding rollers 4 and 6 in one of two opposite directions, and activation of the discharge deflector 25 to discharge the folded sheet.

Detector 30 comprises a photo-sensitive element 35 disposed beneath a diaphragm aperture 36 formed in the entry table 2 at a short distance C from the side stop 15 and at a distance D from detector 31 which, as considered in the direction of sheet feed, is disposed just after the transport nip 13. In the stand-by position of the folding device, the photo-sensitive element 35 is illuminated by a point light source 37, e.g. an LED, disposed straight above the diaphragm aperture 36 and the photosensitive element 35, the point light source 37 being disposed in a cap 38 secured to the side stop 15. The distance between cap 38 and the entry table 2 is sufficient to allow unobstructed supply therebetween of a sheet already folded in one direction. The cap 38, diaphragm aperture 36 and the distance therebetween have dimensions such that the presence or absence of ambient light does not result in any difference in the response of the photosensitive element 35. The use of a detector 30 reacting to interruption of a light beam by a passing sheet has the advantage that the detector 30 is not sensitive to transparent sheets. Since transparent sheets are always original drawings, this prevents their being mistakenly folded.

A sheet supplied against the side stop 15 over the entry table 2 interrupts the light beam between LED 37 and photosensitive element 35, in response to which element 35 delivers a first signal 40 at the time that the leading sheet edge interrupts the light beam and a second signal 41 at the time that the trailing edge passes and again allows the beam of light to reach the photosensitive element 35. Signals 40 and 41 are fed to the control device 33 which, in response to signal 40, delivers a start signal 42 to switch on the coupled drive of the transport rollers 21 and 11 and, in response to signal 41, delivers a control signal 43 to activate the folding station 1 in dependence on the detected length of the supply sheet, such detection being explained hereinafter.

Distance C is approximately 20 mm, small enough to ensure that only a sheet supplied along side stop 15 can interrupt the beam of light between LED 37 and the photosensitive element 35 to activate the folding device and large enough to prevent a sheet supplied fairly obliquely along the side stop 15 from passing with its side edge over the diaphragm aperture 36 and thus giving a detection signal at the wrong time, e.g. to detect too short a sheet length. The distance D is about 410 mm. The choice of this dimension, which governs the length of the entry table 2, is explained hereinafter. As described hereinbefore, detector 31 is disposed just after the transport nip 13, e.g. at a distance E therefrom which is 20 mm. Detector 31 is constructed as a vane detector, a passing sheet edge turning the vane to produce a detection signal 46. The distance F from detector 31 to a line forming the extension of the side stop 15 is less than the minimum width that a sheet folded in one direction can have, e.g., in the case of a conventional minimum folding width of a folded packet of 190 mm the distance F is 150 mm. Thus, detector 31 is always activated by the leading edge of a sheet transported without slip through the transport nip 13. The control device 33 in response to the reception of an associated detection signal 46, delivers a control signal 47 to start the drive for the rollers 3–6, after expiration of a preset period in which the control device 33 may have processed a signal from a detector 32 (to be described hereinafter) for the leading sheet edge or the extension thereof, in a direction in which the leading sheet edge is fed by sheet guide member 16 between the briefly freed folding nip 8 and a folding program set on control panel 49 is performed. Simultaneously with the reception of detection signal 46, the control device 33 starts a count of pulses delivered by the pulse sensor 24. The control device 33 stops this pulse count on reception of a detection signal 41 delivered by photosensitive element 35, on passage of the trailing edge of a supplied sheet past element 35. Taking into account the fixed distance D between the detectors 30 and 31, the control device calculates from the pulse count reached the exact length of a supplied sheet, this measurement being necessary to determine the dimension of a variable folding length within a set folding program for standard sheet formats. For example, for folding sheets of the A3, A2, A1, A0 DIN format, or formats which do not differ greatly therefrom and which can be folded in accordance with the same folding pattern as the associated DIN format, with only a difference in the size of the variable folding lengths within that pattern.

Figure 3:
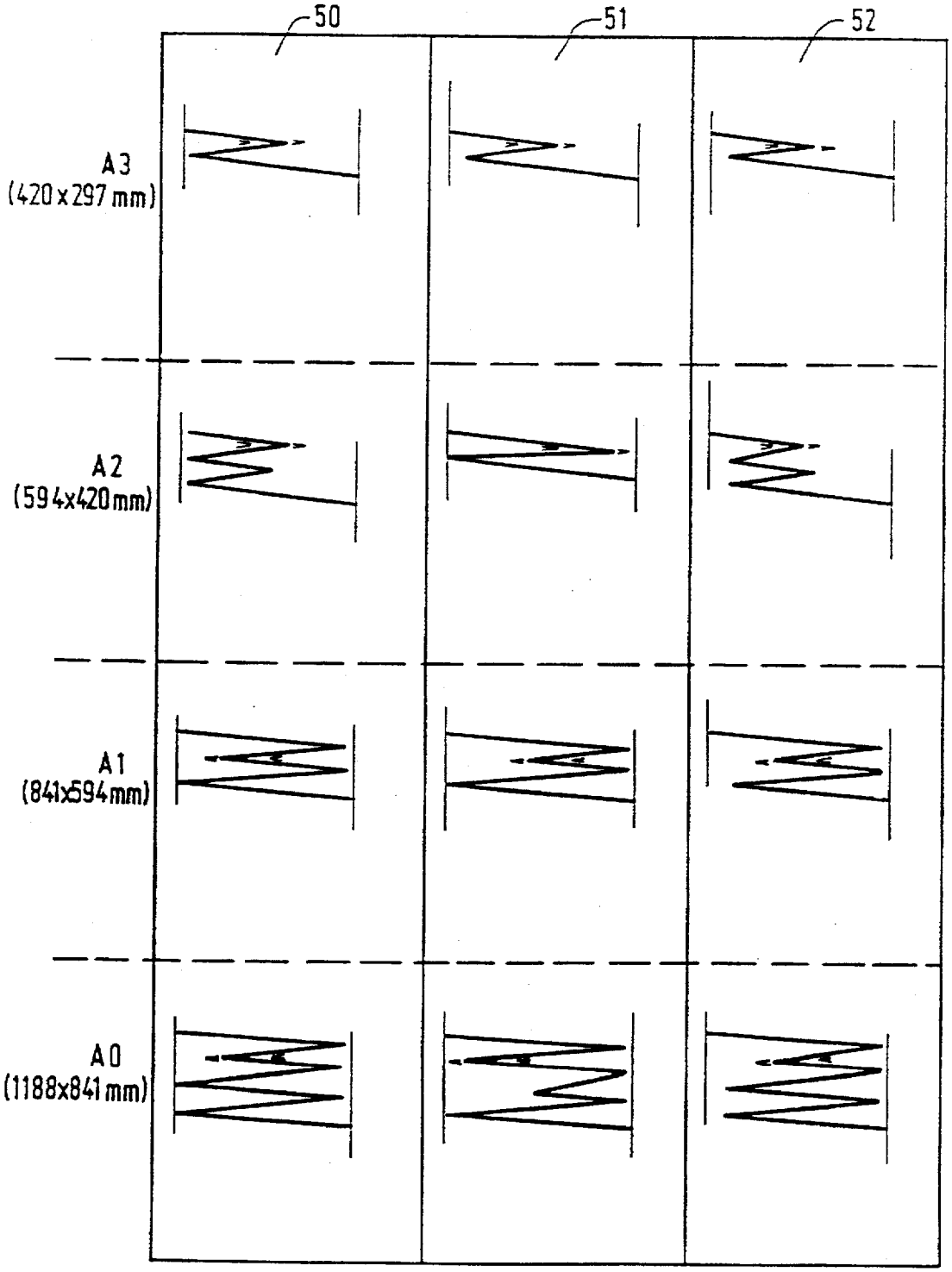
FIG. 3 are folding patterns for a number of standard sheet formats.

By means of a control panel 49 the control device 33 can be set to a number of folding programs for the zig-zag folding of as yet unfolded sheets of different formats to form a packet with a standard dimension, e.g. a folding program 50 for a packet having a width of 190 mm, a folding program 51 for a packet with a width of 210 mm without a binding edge, and a folding program 52 for a packet with a width of 210 mm with a binding edge, these folding programs giving the folding patterns shown in FIG. 3 for the sheet formats A3, A2, A1 and A0.

The folding patterns shown in FIG. 3 in respect of the folding programs 50, 51 and 52 have a 5 mm projection of the top sheet of the drawing on which the drawing legend is disposed, such top sheet being at the bottom of the packets shown in the figure. This projection is adjustable between 0 and 5 mm. The binding edge, which is 20 mm wide in the case of folding program 52, is also adjustable to 25 and 30 mm.

The folding patterns shown in FIG. 3 result in a zig-zag folded packet for the exact DIN formats whose folds, counting from the leading edge (the edge on which the legend is situated) are at the following distances in mm:

| | | | | | | |
|---|---|---|---|---|---|---|
| Folding program 50: | | | | | | |
| A3: | 185 | 115 | | | | |
| A2: | 182 | 95 | 90 | 107 | | |
| A1: | 190 | 185 | 185 | 140.5 | 140.5 | |
| A0: | 190 | 185 | 180 | 180 | 134 | 134 |
| Folding program 51: | | | | | | |
| A3: | 195 | 105 | | | | |
| A2: | 210 | 192 | | | | |
| A1: | 210 | 205 | 110.5 | 110.5 | | |
| A0: | 210 | 205 | 100 | 100 | 184 | 184 |
| Folding program 52: | | | | | | |
| A3: | 190 | 105 | | | | |
| A2: | 190 | 95 | 90 | 97 | | |
| A1: | 190 | 185 | 130.5 | 130.5 | | |
| A0 | 190 | 185 | 180 | 180 | 124 | 124 |

In the case of small differences from the sheet lengths which are respectively 420, 594, 841 and 1188 mm for the A3, A2, A1 and A0 formats, in the case of the folding patterns for A3 and A2 the position of the last fold is adapted and, in the case of the folding patterns for A1 and A0, the position of the last two folds is adapted so that the trailing sheet edge again has the required position in the packet. Variation of the position of the last fold or last fold but one is indicated in the folding patterns by << and >> respectively.

The distance D between the detectors 30 and 31 must be less than the length of the smallest standard sheet format for folding, thus in the case of A3 as the smallest format for folding it must be less than 420 mm, in order to enable the exact sheet length to be determined by pulse counting. However, the distance D must be large enough to enable the appropriate folding pattern of the set folding programs 50, 51 and 52 to be settled in good time. It is sufficient for this to take place in good time for the standard formats smaller than the largest standard format. In the case of non-detection of the smaller standard formats, the control device assumes that the largest standard format or a sheet format differing only slightly therefrom has been presented. It will readily be seen from the folding patterns shown in FIG. 3 that the folding patterns for A1 and A0 of folding program 51 are the most critical. The processing of the first 520 mm thereof is the same. This means that after the supply of 520 mm of an A1 format past detector 31, detector 30 must have released the trailing edge of the sheet so that the distance between detectors 30 and 31 must be greater than 841−520=321 mm in order to enable each required standard folding pattern to be set in good time. However, in accordance with a different criterion to be described hereinafter, the distance D must be 389 mm minimum. In the folding device shown in FIGS. 1 and 2, this other criterion is taken into account with D=410 mm.

Detector 32, which like detector 31 is constructed with a vane which can be turned by the leading edge of a supplied sheet, is disposed, as considered in the direction of sheet feed, at approximately the same level as detector 31, but at a distance G from the side stop 15 which is smaller than the minimum width of an unfolded sheet fed in the longitudinal direction. This width is, for example, the width of an A3 sheet=297 mm or the width of the American B format=279 mm. However, the distance G is larger than the maximum width of a packet folded in one direction. This width is, for example, the width of the A4 format=210 mm or the width of the American 7"×9" format=230 mm. The maximum possible distance G is advantageous in order that a side of a packet which has already been folded in one direction and is fed obliquely may be prevented from activating detector 32 and thus unintentionally switching the folding device to a folding program for making a first fold. In order to prevent the detector 32 from detecting no leading edge in the case of detection of the leading edge by detector 31 in the event of an unfolded sheet whose leading edge extends obliquely rearwardly from the side stop 15, e.g. in the event of a nick in the leading edge at the location of detector 32, with the result that the packet is detected incorrectly as being one already folded in one direction, the control device 33 does not process a detection signal 48 delivered by detector 32, until the leading edge of a sheet is a predetermined number of counting pulses past detector 31. This number, for example, corresponds to a distance of 10 mm sheet movement. Only at that time is the drive for the folding rollers 3–6 started so that if a folding program has been set for folding a packet already folded in one direction the folding rollers can be driven faster than if a folding program has been set to fold a sheet in the first direction, in accordance with Netherlands patent application 9301483 in the name of Océ-Nederland B.V.

On detection of the leading sheet edge by both detector 31 and detector 32, a folding program set on the control panel 49 is activated with the folding pattern associated with the zone length detected by detectors 30 and 31 and after detection thereafter of the trailing sheet edge by detector 30 the position of the last and the last two folds, respectively, is detected in accordance with the exact sheet length detected, and performed accordingly. Given a distance between detector 31 and each of the folding nips 8 and 9 of 90−2=88 mm and a corresponding sheet movement between the time that a folding command is given and the fold is actually made, the folding command for making the next-to-last fold in an A0 sheet must not be given later than the time that the future folding line will be situated at detector 31. Since at that time the trailing edge may still be at detector 30, the distance D in the case of folding program 51 must be greater than 205+184=389 mm. In the case of sheets having a length considerably different from the standard lengths, the pattern for a standard folding with a variable intermediate fold cannot be determined until the exact sheet length is known. For this purpose, the detector 30 must be at a considerable distance from folding station 1, and this would require a long entry table. In order that such sheets can nevertheless be folded to standard packet dimensions without the need for a long entry table, a folding program can be set on control panel 49 for sheets in cases where it is not known whether they have a length within predetermined length zones around standard lengths. In accordance with that folding program, the last fold instead of the next-to-last fold is located at a variable position for greater sheet lengths (A1 and A0). Since, for this, the exact length dimension must be known at a later time, it is sufficient to use the short entry table too.

Figure 4A:
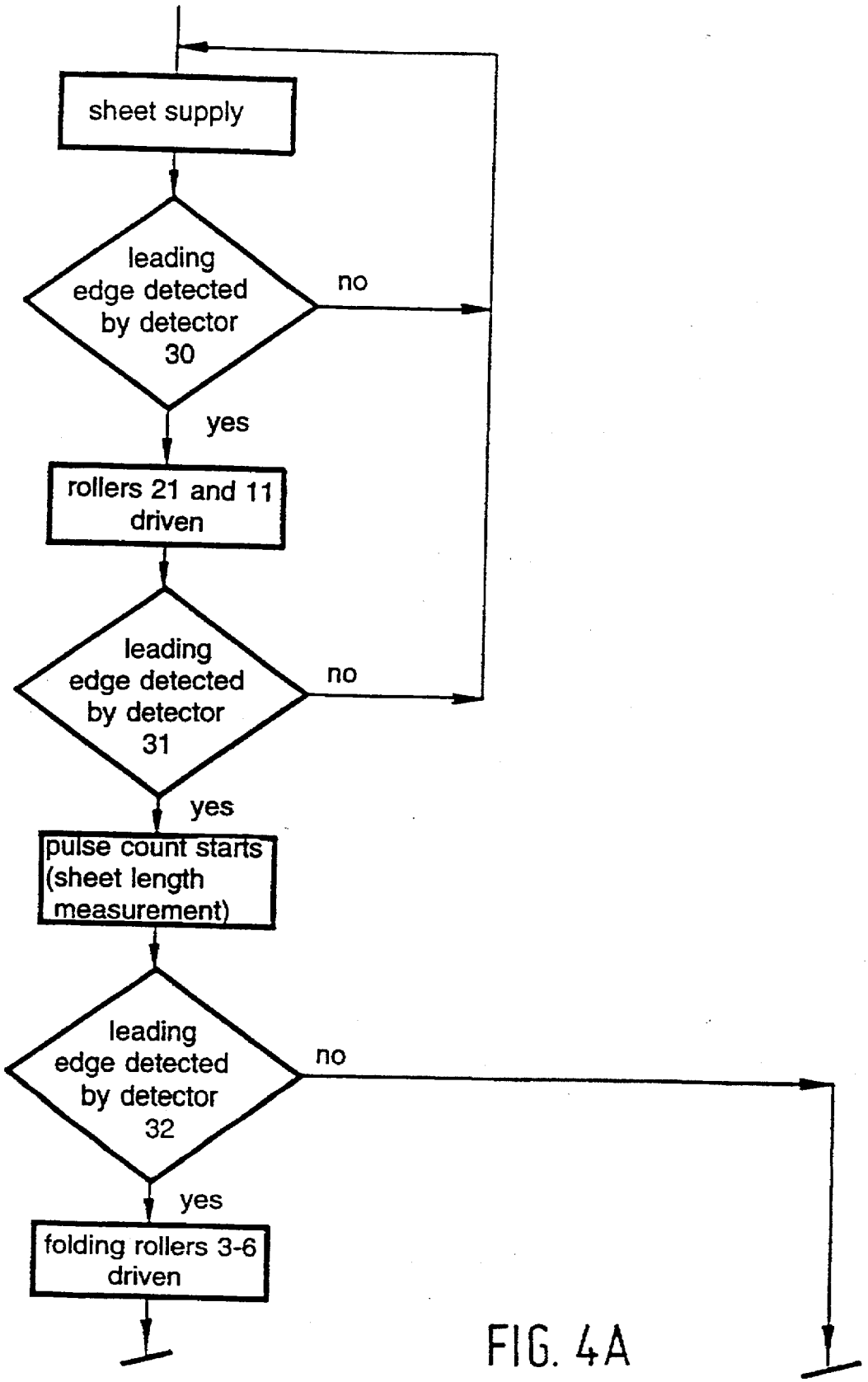
FIGS. 4A, 4B and 4C each show part of a flow diagram illustrating the action of the device shown in FIGS. 1 and 2.
Figure 4B:
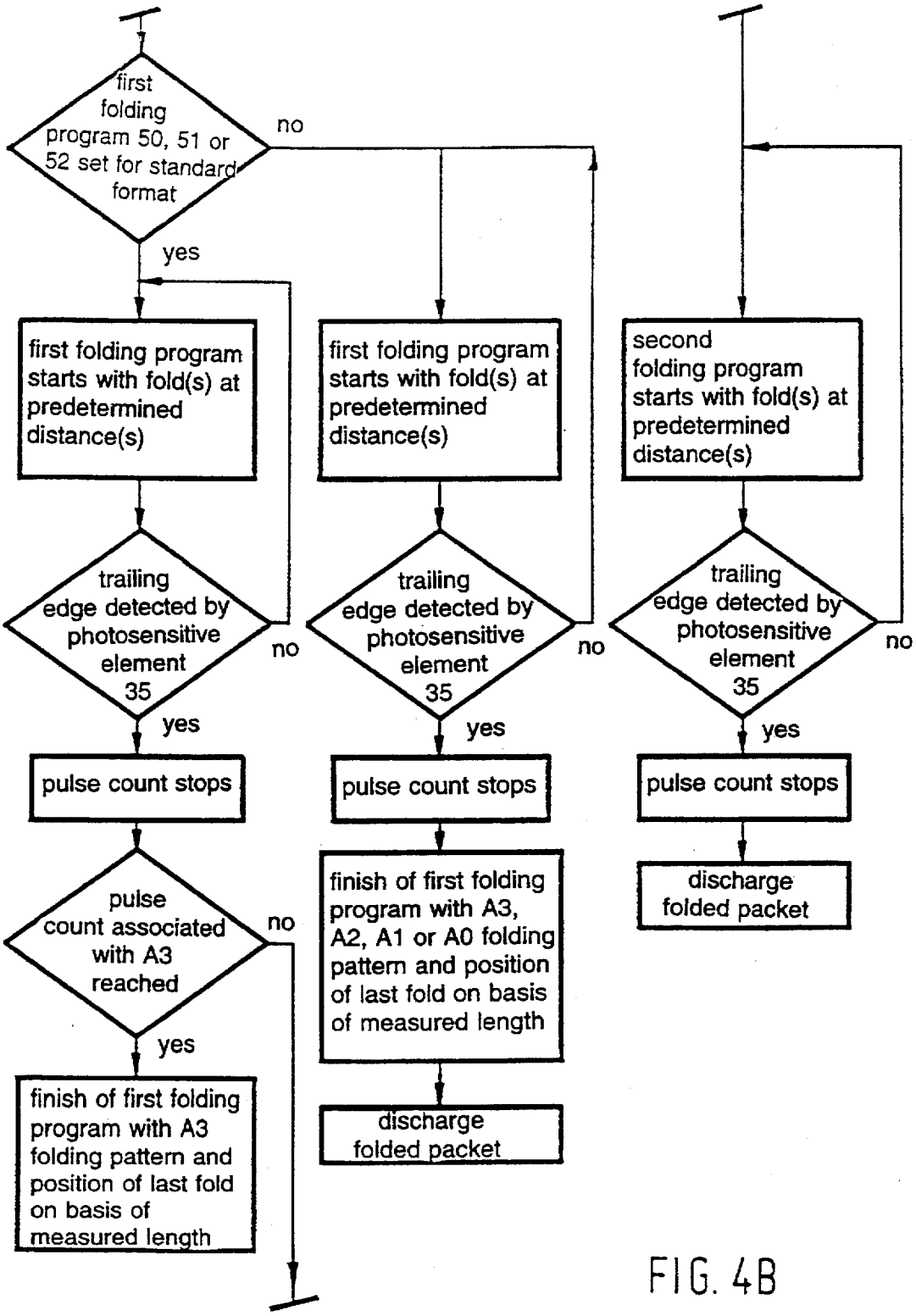
Figure 4C:
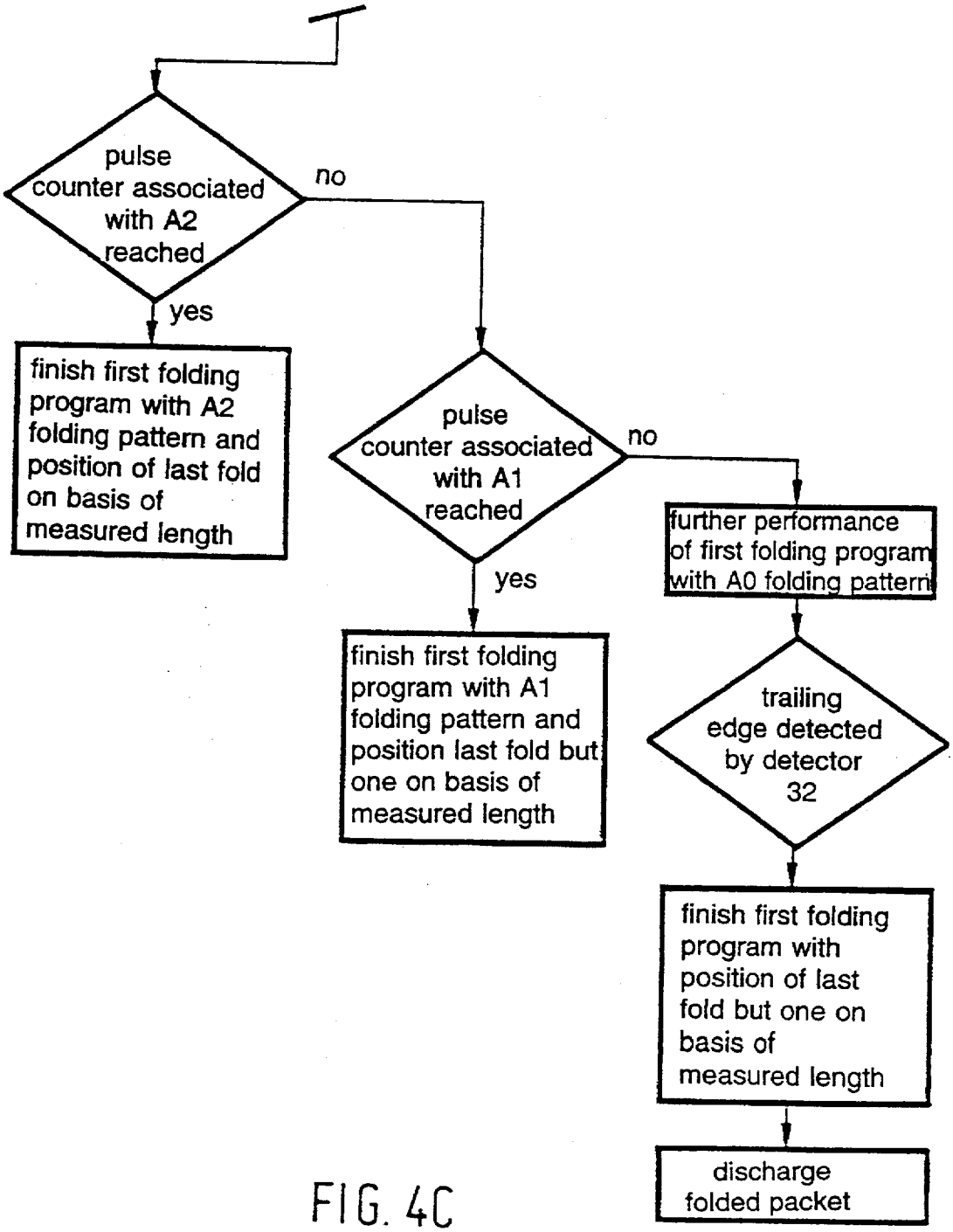

If, after expiration of a short period after activation of detector 31, in which period there is a 10 mm sheet movement, detector 32 has not been activated, then the control device 33 sets the folding station 1 to a folding program for folding the supplied sheet at predetermined regular distances. Thus, a sheet already folded in one direction will be folded once or twice depending upon the length of the packet. The first fold is always made at 297 mm. If the sheet is shorter than 297+297+110 mm, the second fold is made at a distance from the first fold such that the distance between the second fold and the trailing edge is 110 mm. If the sheet is longer than 297+297+110 mm, the second fold is made a distance of 297 from the first fold. The operation of the folding device described hereinbefore is explained in the flow diagram given in FIGS. 4A, 4B and 4C.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for forming folds in a sheet having a first dimension between generally parallel first edges when the sheet is unfolded and a second dimension between generally parallel second edges which are perpendicular to the first edges, the sheet, in a first folded state with at least two folds generally parallel to the first edges, exhibiting a reduced first dimension between the first edges, the apparatus comprising:

feed means for feeding the sheet along a longitudinally extending feed path;

guide means for maintaining an edge of the sheet in general alignment with a side margin of the feed path while moving longitudinally along the feed path;

a first detector for detecting the presence of an unfolded sheet moving longitudinally along the feed path, the first detector being displaced transversely from the side margin of the feed path by a first distance which is greater than the reduced first dimension of the sheet;

a folding station receiving a sheet fed by the feed means and including means for folding the sheet along at least one fold line which extends transversely to the feed path; and control means for operating the folding station to thereby execute (1) a first programmed folding sequence which, in response to a signal from the first detector, forms at least two folds generally parallel to the first edges on an unfolded sheet received with the first edges thereof oriented transversely to the feed path, to thereby effect the first folded state of the sheet and (2) a second programmed folding sequence which forms at least one fold generally parallel to the second edges on a folded sheet received with the second edges thereof oriented transversely to the feed path when no signal is received from the first detector.

2. The apparatus according to claim 1, wherein the first distance is less than the second dimension of the sheet.

3. The apparatus according to claim 2, wherein the first distance is closer in magnitude to the second dimension of the sheet than to the reduced first dimension of the sheet.

4. The apparatus according to any one of claims 1–3, wherein:

the feed means includes transport means disposed in the feed path for effecting slip-free transport of the sheet along the feed path; and the first detector is disposed longitudinally after the transport means along the feed path.

5. The apparatus according to claim 4, and further comprising a second detector for detecting the trailing end of a sheet moving along the feed path, the second detector being disposed in the feed path longitudinally before the transport means and displaced longitudinally from the first detector by a distance which is less than the first dimension of the sheet.

6. The apparatus according to claim 5, and further comprising a third detector for detecting the leading edge of a sheet moving along the feed path, the third detector being disposed in the feed path longitudinally after the transport means and being displaced transversely from the side margin of the feed path by a distance which is less than the reduced first dimension of the sheet.

7. The apparatus according to claim 6, wherein the control means responds to a signal from the first detector at a predetermined time after receiving a signal from the third detector.

8. The apparatus according to claim 6, wherein the third detector is longitudinally displaced from the second detector by a distance which is greater than the reduced first dimension of the sheet plus the dimension between the last fold and the next-to-last fold.

9. The apparatus according to claim 7, wherein the third detector is longitudinally displaced from the second detector by a distance which is greater than the reduced first dimension of the sheet plus the dimension between the last fold and the next-to-last fold.

10. The apparatus according to claim 8, wherein the third detector is longitudinally displaced from the second detector by a distance which is less than the first dimension of the sheet.

11. The apparatus according to claim 9, wherein the third detector is longitudinally displaced from the second detector by a distance which is less than the first dimension of the sheet.

12. The apparatus according to claim 5, wherein the second detector comprises a photosensitive element and a light source disposed opposite to one another on either side of the feed path.

* * * * *